US009462376B2

(12) United States Patent
Alderson

(10) Patent No.: US 9,462,376 B2
(45) **Date of Patent: *Oct. 4, 2016**

(54) SYSTEMS AND METHODS FOR HYBRID ADAPTIVE NOISE CANCELLATION

(71) Applicant: Cirrus Logic, Inc., Austin, TX (US)

(72) Inventor: Jeffrey D. Alderson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 558 days.

This patent is subject to a terminal disclaimer.

(21) Appl. No.: 13/948,566

(22) Filed: Jul. 23, 2013

(65) Prior Publication Data

US 2014/0307887 A1 Oct. 16, 2014

Related U.S. Application Data

(60) Provisional application No. 61/812,384, filed on Apr. 16, 2013, provisional application No. 61/813,426, filed on Apr. 18, 2013, provisional application No. 61/818,150, filed on May 1, 2013.

(51) Int. Cl.
*H04R 3/00* (2006.01)
*G10K 11/16* (2006.01)
*G10K 11/178* (2006.01)

(52) U.S. Cl.
CPC ..... *H04R 3/002* (2013.01); *G10K 11/16* (2013.01); *G10K 11/178* (2013.01); (Continued)

(58) Field of Classification Search
CPC ..... G10K 2210/509; G10K 2210/108; G10K 2210/1081; G10K 2210/3017; G10K 2210/3022; G10K 2210/3026; G10K 2210/3027; G10K 2210/3035; G10K 2210/3039; G10K 2210/3055; G10K 2210/3056; G10K 2210/503; G10K 11/178; G10K 11/16; H04R 3/002
USPC ..... 381/71.1, 71.2, 71.6, 71.8, 71.11, 381/71.12, 93, 94.9, 96
See application file for complete search history.

(56) References Cited

U.S. PATENT DOCUMENTS 5,117,401 A 5/1992 Feintuch
5,251,263 A 10/1993 Andrea et al.
(Continued)

FOREIGN PATENT DOCUMENTS

CN 105284126 A 1/2016
CN 105308678 A 2/2016
(Continued)

OTHER PUBLICATIONS

International Patent Application No. PCT/US2015/017124, International Search Report and Written Opinion, Jul. 13, 2015, 19 pages.
(Continued)

*Primary Examiner* — David Ton
(74) *Attorney, Agent, or Firm* — Jackson Walker L.L.P.

(57) ABSTRACT

In accordance with methods and systems of the present disclosure, a processing circuit may implement a feedback filter having a response that generates a feedback anti-noise signal component from a playback corrected error, the playback corrected error based on a difference between an error microphone signal and a secondary path estimate, and wherein the anti-noise signal comprises at least the feedback anti-noise signal component, a secondary path estimate filter configured to model an electro-acoustic path of the source audio signal and have a response that generates a secondary path estimate from the source audio signal, and a secondary coefficient control block that shapes the response of the secondary path estimate adaptive filter in conformity with a source audio signal and the playback corrected error by adapting the response of the secondary path estimate adaptive filter to minimize the playback corrected error.

87 Claims, 4 Drawing Sheets

(52) U.S. Cl.
CPC ..... *G10K 2210/108* (2013.01); *G10K 2210/1081* (2013.01); *G10K 2210/3017* (2013.01); *G10K 2210/3022* (2013.01); *G10K 2210/3026* (2013.01); *G10K 2210/3027* (2013.01); *G10K 2210/3035* (2013.01); *G10K 2210/3039* (2013.01); *G10K 2210/3055* (2013.01); *G10K 2210/3056* (2013.01); *G10K 2210/503* (2013.01); *G10K 2210/509* (2013.01)

(56) References Cited

U.S. PATENT DOCUMENTS 5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,559,893 A 9/1996 Krokstad
5,586,190 A 12/1996 Trantow et al.
5,640,450 A 6/1997 Watanabe
5,668,747 A 9/1997 Ohashi
5,696,831 A 12/1997 Inanaga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,466,838 B1 12/2008 Moseley
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,249,262 B2 8/2012 Chua et al.
8,290,537 B2 10/2012 Lee et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,942,976 B2 1/2015 Li et al.
8,948,407 B2 2/2015 Alderson et al.
8,958,571 B2 2/2015 Kwatra et al.
8,977,545 B2 3/2015 Zeng et al.
9,066,176 B2 6/2015 Hendrix et al.
9,082,391 B2 7/2015 Yermeche et al.
9,094,744 B1 7/2015 Lu et al.
9,106,989 B2 8/2015 Li et al.
9,107,010 B2 8/2015 Abdollahzadeh Milani et al.
9,264,808 B2 2/2016 Zhou et al.
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 1/2004 He et al.
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Czermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0055910 A1 3/2006 Lee
2006/0069556 A1 3/2006 Nadjar et al.
2006/0109941 A1 5/2006 Keele, Jr.
2006/0153400 A1 7/2006 Fujita et al.
2007/0030989 A1 2/2007 Kates
2007/0033029 A1 2/2007 Sakawaki
2007/0038447 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammad et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.

(56) References Cited

U.S. PATENT DOCUMENTS

2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124335 A1 5/2010 Shridhar et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Marcel et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0310087 A1 12/2010 Ishida
2010/0316225 A1 12/2010 Saito et al.
2010/0322430 A1 12/2010 Isberg
2011/0002468 A1 1/2011 Tanghe
2011/0007907 A1 1/2011 Park et al.
2011/0026724 A1 2/2011 Doclo
2011/0096933 A1 4/2011 Eastty
2011/0099010 A1 4/2011 Zhang
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson et al.
2011/0249826 A1* 10/2011 Van Leest ..... G10K 11/178 381/71.8
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0185524 A1 7/2012 Clark
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1 6/2013 Birch et al.
2013/0222516 A1 8/2013 Do et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0036127 A1 2/2014 Pong et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270223 A1 9/2014 Li et al.
2014/0270224 A1 9/2014 Zhou et al.
2014/0277022 A1 9/2014 Perrin et al.
2014/0294182 A1 10/2014 Axelsson
2014/0307887 A1 10/2014 Alderson et al.
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellman
2014/0314247 A1 10/2014 Zhang
2014/0341388 A1 11/2014 Goldstein
2014/0369517 A1 12/2014 Zhou et al.
2015/0078572 A1 3/2015 Abdollahzadeh Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0256660 A1 9/2015 Kaller et al.
2015/0256953 A1 9/2015 Kwatra et al.
2015/0269926 A1 9/2015 Alderson et al.
2015/0365761 A1 12/2015 Alderson et al.

FOREIGN PATENT DOCUMENTS

CN 105324810 A 2/2016
CN 105453170 A 3/2016
CN 105453587 A 3/2016
DE 102011013343 A1 9/2012
EP 0412902 A2 2/1991
EP 0756407 A2 1/1997
EP 0898266 A2 2/1999
EP 1691577 A2 8/2006
EP 1880699 A2 1/2008
EP 1947642 A1 7/2008
EP 2133866 A1 12/2009
EP 2237573 A1 10/2010
EP 2216774 A1 8/2011
EP 239550 A1 12/2011

(56) References Cited

FOREIGN PATENT DOCUMENTS

| | | | |
|---|---|---|---|
| EP | 2395501 | A1 | 12/2011 |
| EP | 2551845 | A1 | 1/2013 |
| EP | 2583074 | A1 | 4/2013 |
| EP | 2984648 | A2 | 2/2016 |
| EP | 2987160 | A1 | 2/2016 |
| EP | 2987162 | A1 | 2/2016 |
| EP | 2987337 | A1 | 2/2016 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| JP | H06186985 | A | 7/1994 |
| JP | H06232755 | | 8/1994 |
| JP | 07325588 | A | 12/1995 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2010277025 | | 12/2010 |
| JP | 2011061449 | | 3/2011 |
| WO | 9911045 | | 3/1999 |
| WO | 03015275 | A1 | 2/2003 |
| WO | 2003015074 | A1 | 2/2003 |
| WO | WO2004009007 | A1 | 1/2004 |
| WO | 2004017303 | A1 | 2/2004 |
| WO | 2006125061 | A1 | 11/2006 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2010117714 | A1 | 10/2010 |
| WO | 2011035061 | A1 | 3/2011 |
| WO | 2012107561 | A1 | 8/2012 |
| WO | 2012119808 | A2 | 9/2012 |
| WO | 2012134874 | A1 | 10/2012 |
| WO | 2012166273 | A2 | 12/2012 |
| WO | 2012166388 | A2 | 12/2012 |
| WO | 2013106370 | A1 | 7/2013 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088639 | A1 | 6/2015 |
| WO | 2015088651 | A1 | 6/2015 |
| WO | 2015088653 | A1 | 6/2015 |
| WO | 2015134225 | A1 | 9/2015 |
| WO | 2015191691 | A1 | 12/2015 |

OTHER PUBLICATIONS

International Patent Application No. PCT/US2015/035073, International Search Report and Written Opinion, Oct. 8, 2015, 11 pages.

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Toochinda, et al. "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMS Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

Davari, et al., "A New Online Secondary Path Modeling Method for Feedforward Active Noise Control Systems," IEEE International Conference on Industrial Technology, Apr. 21-24, 2008, pp. 1-6, Chengdu, China.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

D. Senderowicz et al., "Low-Voltage Double-Sampled Delta-Sigma Converters," IEEE J. Solid-State Circuits, vol. 37, pp. 1215-1225, Dec. 1997, 13 pages.

P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.

Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.

Booji, P.S., Berkhoff, A.P., Virtual sensors for local, three dimensional, broadband multiple-channel active noise control and the effects on the quiet zones, Proceedings of ISMA2010 including USD2010, pp. 151-166.

International Patent Application No. PCT/US2014/049600, International Search Report and Written Opinion, Jan. 14, 2015, 12 pages.

International Patent Application No. PCT/US2014/061753, International Search Report and Written Opinion, Feb. 9, 2015, 8 pages.

International Patent Application No. PCT/US2014/061548, International Search Report and Written Opinion, Feb. 12, 2015, 13 pages.

International Patent Application No. PCT/US2014/060277, International Search Report and Written Opinion, Mar. 9, 2015, 11 pages.

Kuo, Sen and Tsai, Jianming, Residual noise shaping technique for active noise control systems, J. Acoust. Soc. Am. 95 (3), Mar. 1994, pp. 1665-1668.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

(56) References Cited

OTHER PUBLICATIONS

Cohen, et al., "Noise Estimation by Minima Controlled Recursive Averaging for Robust Speech Enhancement", IEEE Signal Processing Letters, Vol. 9, No. 1, Jan. 2002.
Martin, "Noise Power Spectral Density Estimation Based on Optimal Smoothing and Minimum Statistics", IEEE Trans. on Speech and Audio Processing, col. 9, No. 5, Jul. 2001.
Martin, "Spectral Subtraction Based on Minimum Statistics", Proc. 7th EUSIPCO '94, Edinburgh, U.K., Sep. 13-16, 1994, pp. 1182-1195.
Cohen, "Noise Spectrum Estimation in Adverse Environments: Improved Minima Controlled Recursive Averaging", IEEE Trans. on Speech & Audio Proc., vol. 11, Issue 5, Sep. 2003.
Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.
Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, May 27, 2014, 11 pages.
Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
International Patent Application No. PCT/US2014/017112, International Search Report and Written Opinion, May 8, 2015, 22 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 14 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, Jul. 23, 2015, 13 pages.
Combined Search and Examination Report, Application No. GB1512832.5, mailed Jan. 28, 2016, 7 pages.
International Patent Application No. PCT/US2015/066260, International Search Report and Written Opinion, Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, mailed Apr. 21, 2016, 5 pages.

* cited by examiner

SYSTEMS AND METHODS FOR HYBRID ADAPTIVE NOISE CANCELLATION

RELATED APPLICATION

The present disclosure claims priority to U.S. Provisional Patent Application Ser. No. 61/812,384, filed Apr. 16, 2013, which is incorporated by reference herein in its entirety.

The present disclosure claims priority to U.S. Provisional Patent Application Ser. No. 61/813,426, filed Apr. 18, 2013, which is incorporated by reference herein in its entirety.

The present disclosure also claims priority to U.S. Provisional Patent Application Ser. No. 61/818,150, filed May 1, 2013, which is incorporated by reference herein in its entirety.

FIELD OF DISCLOSURE

The present disclosure relates in general to adaptive noise cancellation in connection with an acoustic transducer, and more particularly, to detection and cancellation of ambient noise present in the vicinity of the acoustic transducer using both feedforward and feedback adaptive noise cancellation techniques and including monitoring of a secondary path estimate adaptive filter for modeling an electro-acoustic path for the acoustic transducer.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

In a traditional hybrid adaptive noise cancellation system that includes both feedforward anti-noise and feedback anti-noise, an error microphone is used to generate an error microphone signal that measures a combined acoustic pressure at an acoustic transducer (e.g., loudspeaker) including playback of a source audio signal and ambient sounds. The error microphone signal is used to generate feedback anti-noise as well as adapt a feedforward adaptive filter for generating feedforward anti-noise from a reference microphone signal configured to measure ambient sounds.

In generating the feedback anti-noise, it is critical that the feedback noise cancelling system cancel only ambient noise at the error microphone, but not the playback signal. Accordingly, a feedback adaptive noise cancellation system will often generate a playback corrected error signal equal to the error microphone signal that is typically reduced by a filtered version of the source audio signal, wherein the filter estimates the secondary path, which is the electro-acoustic path of the source audio signal through an acoustic transducer. If modeled correctly, the playback corrected error signal will be approximately equal to the ambient noise level present at the acoustic transducer.

In traditional approaches, the secondary path is estimated using offline testing and characterization, on the assumption that the secondary path does not significantly change from user to user. However, in actual application, the acoustic environment around an audio device can change dramatically, depending on the sources of noise that are present, the position of the device itself, and the physical characteristics of the user, and it may be desirable to adapt noise cancellation to take into account such environmental changes.

SUMMARY

In accordance with the teachings of the present disclosure, the disadvantages and problems associated with detection and reduction of ambient noise associated with an acoustic transducer may be reduced or eliminated.

In accordance with embodiments of the present disclosure, a personal audio device may include a personal audio device housing, a transducer, a reference microphone, an error microphone, and a processing circuit. The transducer may be coupled to the housing for reproducing an audio signal including both a source audio signal for playback to a listener and an anti-noise signal for countering the effects of ambient audio sounds in an acoustic output of the transducer. The reference microphone may be coupled to the housing for providing a reference microphone signal indicative of the ambient audio sounds. The error microphone may be coupled to the housing in proximity to the transducer for providing an error microphone signal indicative of the acoustic output of the transducer and the ambient audio sounds at the transducer. The processing circuit may implement a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component, a secondary path estimate filter configured to model an electro-acoustic path of the source audio signal and have a response that generates a secondary path estimate from the source audio signal, and a secondary coefficient control block that shapes the response of the secondary path estimate adaptive filter in conformity with the source audio signal and the playback corrected error by adapting the response of the secondary path estimate adaptive filter to minimize the playback corrected error.

In accordance with these and other embodiments of the present disclosure, a method for canceling ambient audio sounds in the proximity of a transducer of a personal audio device may include receiving a reference microphone signal indicative of the ambient audio sounds. The method may also include receiving an error microphone signal indicative of the output of the transducer and the ambient audio sounds at the transducer. The method may further include generating a source audio signal for playback to a listener. The method may additionally include generating a feedback anti-noise signal component from a playback corrected error, the playback corrected error based on a difference between the error microphone signal and a secondary path estimate, countering the effects of ambient audio sounds at an acoustic output of the transducer, wherein an anti-noise signal comprises at least the feedback anti-noise signal component. The method may also include adaptively generating the secondary path estimate from the source audio signal by filtering the source audio signal with a secondary path estimate adaptive filter modeling an electro-acoustic path of the source audio signal and adapting the response of the secondary path estimate adaptive filter to minimize the playback corrected error. The method may further include combining the anti-noise signal with the source audio signal to generate an audio signal provided to the transducer.

In accordance with these and other embodiments of the present disclosure, an integrated circuit for implementing at least a portion of a personal audio device may include an output, a reference microphone input, an error microphone input, and a processing circuit. The output may be for providing a signal to a transducer including both a source audio signal for playback to a listener and an anti-noise signal for countering the effect of ambient audio sounds in an acoustic output of the transducer. The reference microphone input may be for receiving a reference microphone signal indicative of the ambient audio sounds. The error microphone input may be for receiving an error microphone signal indicative of the output of the transducer and the ambient audio sounds at the transducer. The processing circuit may implement a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component, a secondary path estimate filter configured to model an electro-acoustic path of the source audio signal and have a response that generates a secondary path estimate from the source audio signal, and a secondary coefficient control block that shapes the response of the secondary path estimate adaptive filter in conformity with the source audio signal and the playback corrected error by adapting the response of the secondary path estimate adaptive filter to minimize the playback corrected error.

In accordance with these and other embodiments of the present disclosure, a personal audio device may include a personal audio device housing, a transducer, an error microphone, and a processing circuit, The transducer may be coupled to the housing for reproducing an audio signal including both a source audio signal for playback to a listener and an anti-noise signal for countering the effects of ambient audio sounds in an acoustic output of the transducer. The error microphone may be coupled to the housing in proximity to the transducer for providing an error microphone signal indicative of the acoustic output of the transducer and the ambient audio sounds at the transducer. The processing circuit may implement a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component; a secondary path estimate filter configured to model an electro-acoustic path of the source audio signal and have a response that generates a secondary path estimate from the source audio signal; and a programmable feedback gain, wherein an increasing programmable feedback gain increases the feedback anti-noise signal component and a decreasing programmable feedback gain decreases the feedback anti-noise signal component.

In accordance with these and other embodiments of the present disclosure, a method for canceling ambient audio sounds in the proximity of a transducer of a personal audio device including receiving an error microphone signal indicative of the output of the transducer and the ambient audio sounds at the transducer. The method may also include generating a source audio signal for playback to a listener. The method may further include generating a feedback anti-noise signal component from a playback corrected error, the playback corrected error based on a difference between the error microphone signal and a secondary path estimate, countering the effects of ambient audio sounds at an acoustic output of the transducer, wherein an anti-noise signal comprises at least the feedback anti-noise signal component. The method may additionally include generating the secondary path estimate from the source audio signal by filtering the source audio signal with a secondary path estimate filter modeling an electro-acoustic path of the source audio signal. The method may also include applying a programmable feedback gain to a path of the feedback anti-noise signal component, wherein an increasing programmable feedback gain increases the feedback anti-noise signal component and a decreasing programmable feedback gain decreases the feedback anti-noise signal component. The method may further include combining the anti-noise signal with a source audio signal to generate an audio signal provided to the transducer.

In accordance with these and other embodiments of the present disclosure, an integrated circuit for implementing at least a portion of a personal audio device may include and output, an error microphone input, and a processing circuit. The output may be for providing a signal to a transducer including both a source audio signal for playback to a listener and an anti-noise signal for countering the effect of ambient audio sounds in an acoustic output of the transducer. The error microphone input may be for receiving an error microphone signal indicative of the output of the transducer and the ambient audio sounds at the transducer. The processing circuit may implement a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component; a secondary path estimate filter configured to model an electro-acoustic path of the source audio signal and have a response that generates a secondary path estimate from the source audio signal; and a programmable feedback gain, wherein an increasing programmable feedback gain increases the feedback anti-noise signal component and a decreasing programmable feedback gain decreases the feedback anti-noise signal component.

In accordance with these and other embodiments of the present disclosure, a personal audio device may include a personal audio device housing, a transducer, a reference microphone, an error microphone, and a processing circuit. The transducer may be coupled to the housing for reproducing an audio signal including both a source audio signal for playback to a listener and an anti-noise signal for countering the effects of ambient audio sounds in an acoustic output of the transducer. The reference microphone may be coupled to the housing for providing a reference microphone signal indicative of the ambient audio sounds. The error microphone may be coupled to the housing in proximity to the transducer for providing an error microphone signal indicative of the acoustic output of the transducer and the ambient audio sounds at the transducer. The processing circuit may implement a feedback filter having a response that generates a feedback anti-noise signal component from a playback corrected error, the playback corrected error based on a difference between the error microphone signal and a secondary path estimate, a feedforward filter having a response that generates a feedforward anti-noise signal component from the reference microphone signal, wherein the anti-noise signal comprises at least the feedback anti-noise signal component and the feedforward anti-noise signal component, wherein the feedforward filter is configured to be disabled from generating the feedforward anti-noise signal component responsive to a disturbance in the reference microphone signal, and a secondary path estimate filter configured to model an electro-acoustic path of the source audio signal and have a response that generates a secondary path estimate from the source audio signal.

In accordance with these and other embodiments of the present disclosure, a method for canceling ambient audio sounds in the proximity of a transducer of a personal audio device may include receiving a reference microphone signal indicative of the ambient audio sounds. The method may also include receiving an error microphone signal indicative of the output of the transducer and the ambient audio sounds at the transducer. The method may further include generating a source audio signal for playback to a listener. The method may additionally include generating a feedback anti-noise signal component from a playback corrected error, the playback corrected error based on a difference between the error microphone signal and a secondary path estimate, countering the effects of ambient audio sounds at an acoustic output of the transducer, wherein an anti-noise signal comprises at least the feedback anti-noise signal component. The method may also include generating the secondary path estimate from the source audio signal by filtering the source audio signal with a secondary path estimate filter modeling an electro-acoustic path of the source audio signal. The method may further include generating a feedforward anti-noise signal component, from a result of the measuring with the reference microphone, countering the effects of ambient audio sounds at an acoustic output of the transducer by filtering with a feedforward filter an output of the reference microphone, wherein the anti-noise signal comprises at least the feedback anti-noise signal component and the feedforward anti-noise signal component. The method may additionally include disabling the feedforward filter from generating the feedforward anti-noise signal component responsive to a disturbance in the reference microphone signal. The method may also include combining the anti-noise signal with a source audio signal to generate an audio signal provided to the transducer.

In accordance with these and other embodiments of the present disclosure, an integrated circuit for implementing at least a portion of a personal audio device may include an output, a reference microphone input, an error microphone input, and a processing circuit. The output may be for providing a signal to a transducer including both a source audio signal for playback to a listener and an anti-noise signal for countering the effect of ambient audio sounds in an acoustic output of the transducer. The reference microphone input may be for receiving a reference microphone signal indicative of the ambient audio sounds. The error microphone input may be for receiving an error microphone signal indicative of the output of the transducer and the ambient audio sounds at the transducer. The processing circuit may implement a feedback filter having a response that generates a feedback anti-noise signal component from a playback corrected error, the playback corrected error based on a difference between the error microphone signal and a secondary path estimate, a feedforward filter having a response that generates a feedforward anti-noise signal component from the reference microphone signal, wherein the anti-noise signal comprises at least the feedback anti-noise signal component and the feedforward anti-noise signal component, wherein the feedforward filter is configured to be disabled from generating the feedforward anti-noise signal component responsive to a disturbance in the reference microphone signal, and a secondary path estimate filter configured to model an electro-acoustic path of the source audio signal and have a response that generates a secondary path estimate from the source audio signal.

In accordance with these and other embodiments of the present disclosure, a personal audio device may include a personal audio device housing, a transducer, a reference microphone, an error microphone, and a processing circuit. The transducer may be coupled to the housing for reproducing an audio signal including both a source audio signal for playback to a listener and an anti-noise signal for countering the effects of ambient audio sounds in an acoustic output of the transducer. The reference microphone may be coupled to the housing for providing a reference microphone signal indicative of the ambient audio sounds. The error microphone may be coupled to the housing in proximity to the transducer for providing an error microphone signal indicative of the acoustic output of the transducer and the ambient audio sounds at the transducer. The processing circuit may implement at least one of: a feedback filter having a response that generates at least a portion of the anti-noise component from a playback corrected error, the playback corrected error based on a difference between the error microphone signal and a secondary path estimate; and a feedforward filter having a response that generates at least a portion of the anti-noise signal from the reference microphone signal. The processing circuit may also implement a secondary path estimate filter configured to model an electro-acoustic path of the source audio signal and have a response that generates a secondary path estimate from the source audio signal and a secondary path estimate performance monitor for monitoring performance of the secondary path estimate filter in modeling the electro-acoustic path.

In accordance with these and other embodiments of the present disclosure, a method for canceling ambient audio sounds in the proximity of a transducer of a personal audio device may include receiving a reference microphone signal indicative of the ambient audio sounds. The method may also include receiving an error microphone signal indicative of the output of the transducer and the ambient audio sounds at the transducer. The method may further include generating a source audio signal for playback to a listener. The method may additionally include generating an anti-noise signal, comprising at least one of: generating a feedback anti-noise signal component comprising at least a portion of the anti-noise signal from a playback corrected error, the playback corrected error based on a difference between the error microphone signal and a secondary path estimate, countering the effects of ambient audio sounds at an acoustic output of the transducer; and generating a feedforward anti-noise signal component comprising at least a portion of the anti-noise signal, from a result of the measuring with the reference microphone, countering the effects of ambient audio sounds at an acoustic output of the transducer by filtering an output of the reference microphone. The method may also include generating the secondary path estimate from the source audio signal by filtering the source audio signal with a secondary path estimate filter modeling an electro-acoustic path of the source audio signal. The method may further include monitoring with a secondary path estimate performance monitor performance of the secondary path estimate filter in modeling the electro-acoustic path. The method may additionally include combining the anti-noise signal with a source audio signal to generate an audio signal provided to the transducer.

In accordance with these and other embodiments of the present disclosure, an integrated circuit for implementing at least a portion of a personal audio device may include an output, a reference microphone input, an error microphone input, and a processing circuit. The output may be for providing a signal to a transducer including both a source audio signal for playback to a listener and an anti-noise signal for countering the effect of ambient audio sounds in an acoustic output of the transducer. The reference microphone input may be for receiving a reference microphone signal indicative of the ambient audio sounds. The error microphone input may be for receiving an error microphone signal indicative of the output of the transducer and the ambient audio sounds at the transducer. The processing circuit may implement at least one of: a feedback filter having a response that generates at least a portion of the anti-noise component from a playback corrected error, the playback corrected error based on a difference between the error microphone signal and a secondary path estimate; and a feedforward filter having a response that generates at least a portion of the anti-noise signal from the reference microphone signal. The processing circuit may also implement a secondary path estimate filter configured to model an electro-acoustic path of the source audio signal and have a response that generates a secondary path estimate from the source audio signal and a secondary path estimate performance monitor for monitoring performance of the secondary path estimate filter in modeling the electro-acoustic path.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electro-acoustic path from the output of the processing circuit through the transducer.

Figure 1A:
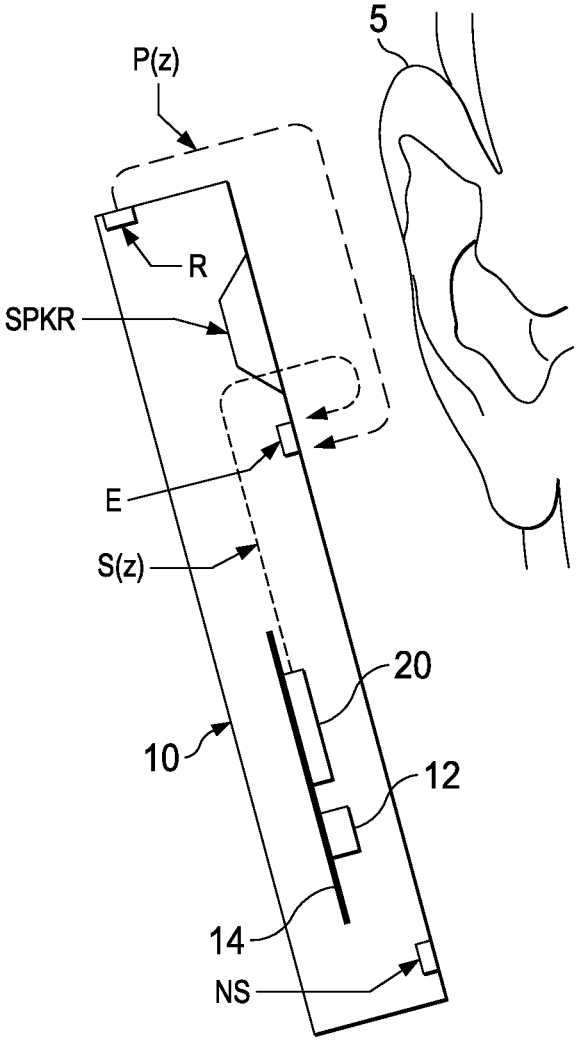
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the claims. Wireless telephone 10 may include a transducer, such as speaker SPKR, that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In different embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes.

Figure 1B:
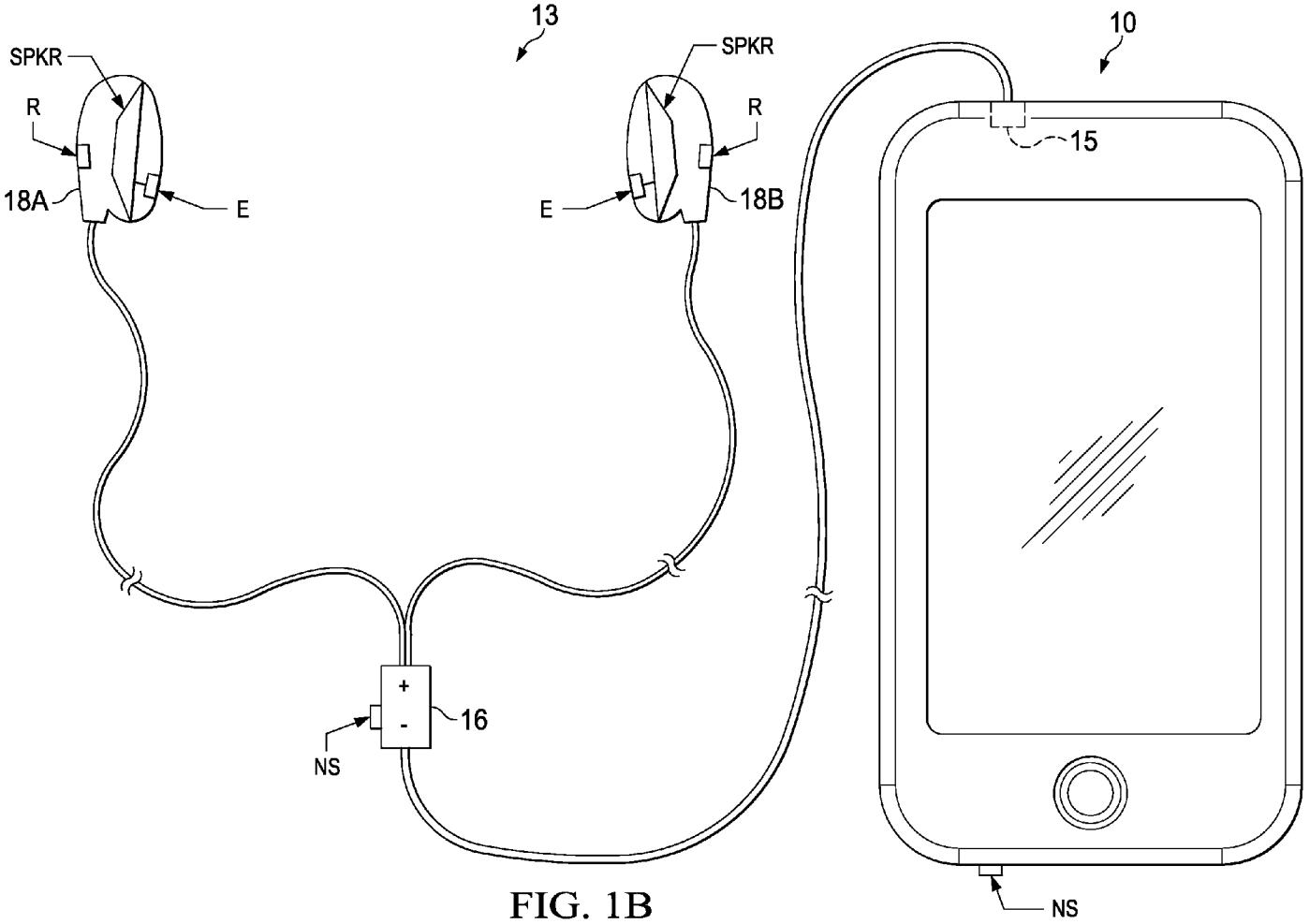
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone," may refer to intra-concha earphones, supra-concha earphones, and supra-aural earphones.

Combox 16 or another portion of headphone assembly 13 may have a near-speech microphone NS that may capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
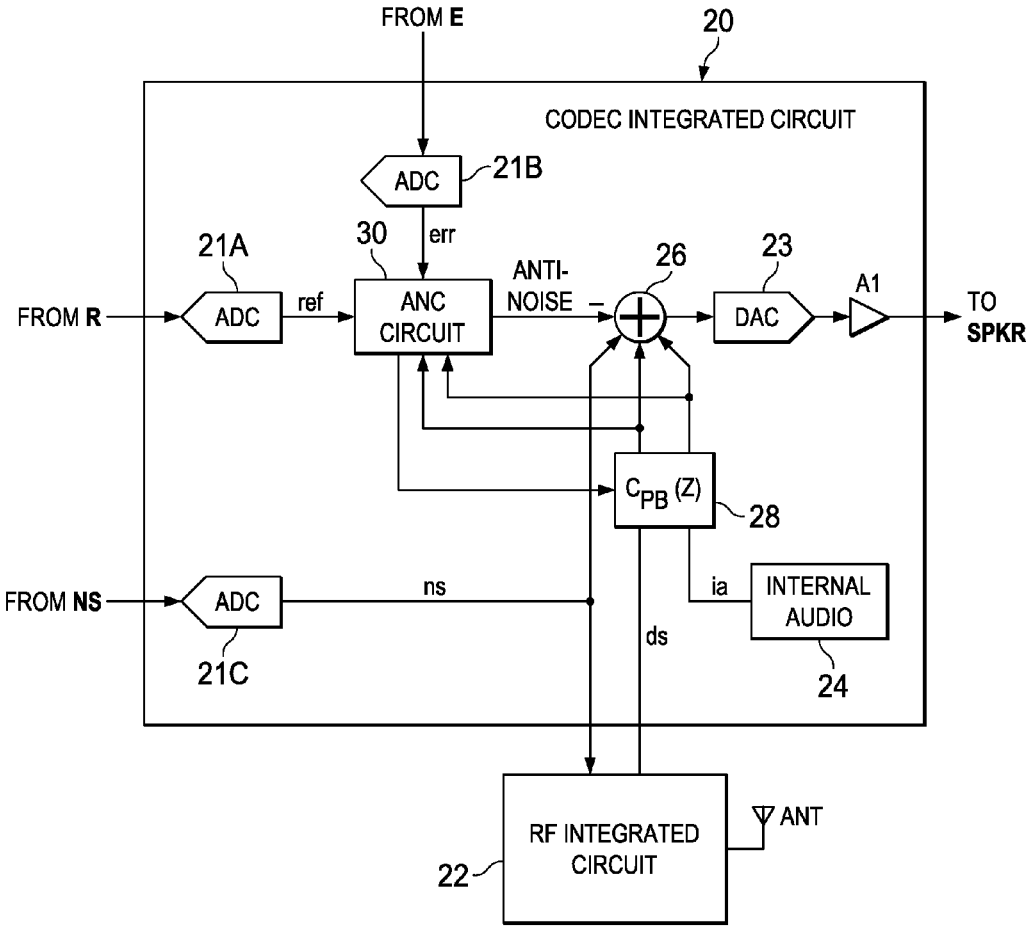
FIG. 2 is a block diagram of selected circuits within the wireless telephone depicted in FIG. 1A, in accordance with embodiments of the present disclosure.

Referring now to FIG. 2, selected circuits within wireless telephone 10 are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals ia from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

As shown in FIG. 2, signals ds and/or ia may first be filtered by compensating filter 28 with a response $C_{PB}(z)$. As explained in greater detail below, compensating filter 28 may boost a source audio signal comprising signals ds and/or ia within a frequency range responsive to a determination by a secondary path estimate performance monitor 48 of ANC circuit 30 that a secondary path estimate adaptive filter 34A of ANC circuit 30 (depicted in FIG. 3) is not sufficiently modeling an electro-acoustic path of the source audio signal for the frequency range of sound, as described in greater detail below.

Figure 3:
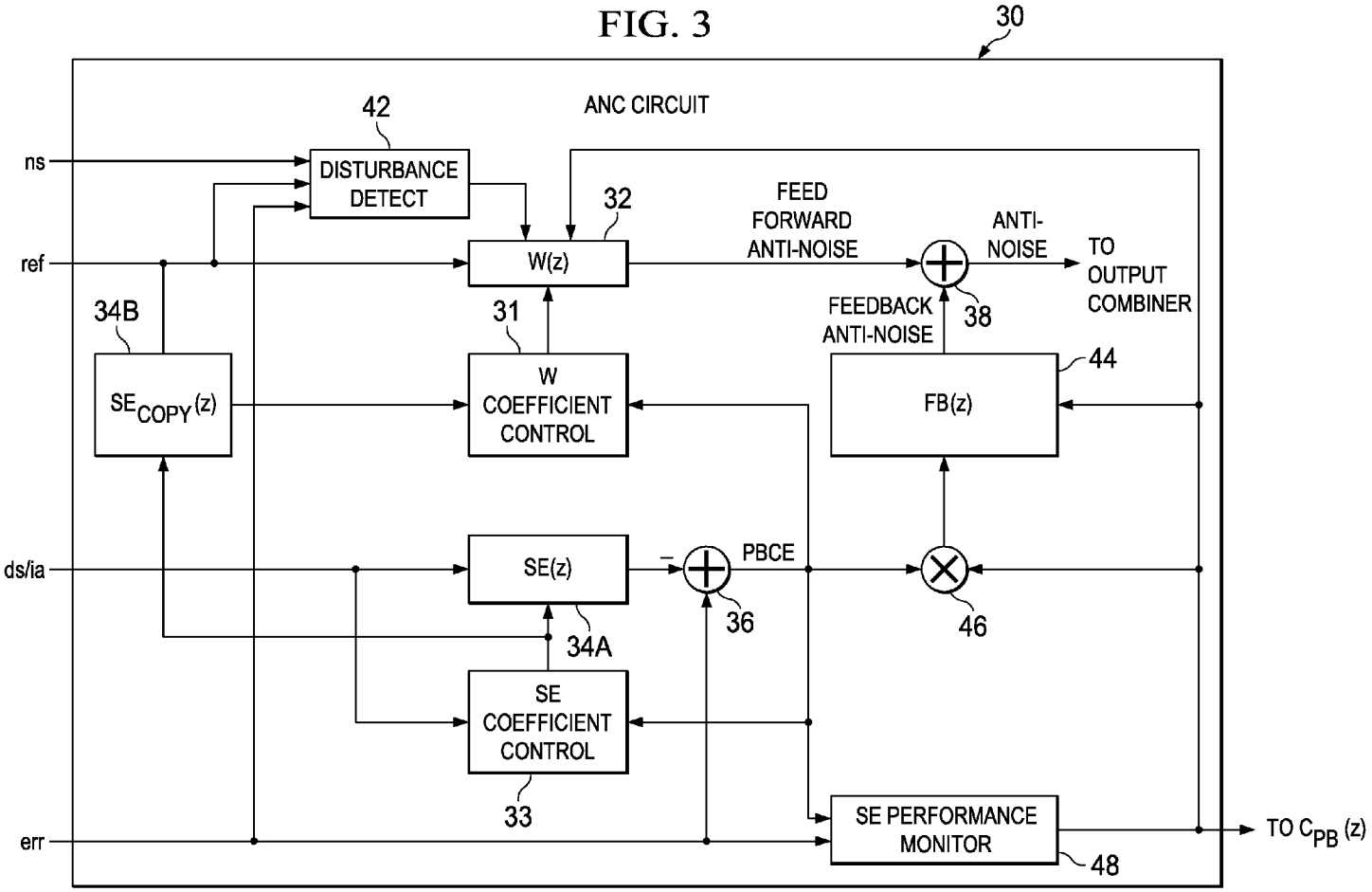
FIG. 3 is a block diagram depicting selected signal processing circuits and functional blocks within an example active noise canceling (ANC) circuit of a coder-decoder (CODEC) integrated circuit of FIG. 3, in accordance with embodiments of the present disclosure.

Referring now to FIG. 3, details of ANC circuit 30 are shown in accordance with embodiments of the present disclosure. Adaptive filter 32 may receive reference microphone signal ref and under ideal circumstances, may adapt its transfer function W(z) to be P(z)/S(z) to generate a feedforward anti-noise component of the anti-noise signal, which may be combined by combiner 38 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the ambient audio sounds in the error microphone signal, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err. However, by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36 to generate a playback-corrected error, shown as PBCE in FIG. 3. SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As shown in FIG. 3, ANC circuit 30 may also comprise a disturbance detect block 42. Disturbance detect block 42 may include any system, device, or apparatus configured to detect a signal disturbance based on sound incident at reference microphone R, error microphone E, and/or near-speech microphone NS. As used herein, the term "signal disturbance" may include any sound impinging on reference microphone R, error microphone E, and/or near-speech microphone NS that might be expected to falsely influence generation of the feedforward anti-noise component, and may include speech or other sounds occurring close to the reference microphone, error microphone E, and/or near-speech microphone NS, the presence of ambient wind, physical contact of an object with the reference microphone error microphone E, and/or near-speech microphone NS, a momentary tone, and/or any other similar sound. As shown in FIG. 3, disturbance detect block 42 may detect such a signal disturbance based on reference microphone signal ref, error microphone signal err, and/or near-speech microphone signal NS. However, in these and other embodiments, disturbance detect block 42 may detect such a signal disturbance based on any other sensor associated with wireless telephone 10. If disturbance detect block 42 detects a disturbance, it may communicate a signal to feedforward adaptive filter 32 that may disable feedforward adaptive filter 32 from generating the feedforward anti-noise component, such that ANC circuit 30 generates only the feedback anti-noise component during the time in which a signal disturbance is present.

As depicted in FIG. 3, ANC circuit 30 may also comprise feedback filter 44. Feedback filter 44 may receive the playback corrected error signal PBCE and may apply a response FB(z) to generate a feedback anti-noise component of the anti-noise signal based on the playback corrected error which may be combined by combiner 38 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2. Also as depicted in FIG. 3, a path of the feedback anti-noise component may have a programmable gain element 46, such that an increased gain will cause increased noise cancellation of the feedback anti-noise component, and decreasing the gain will cause reduced noise cancellation of the feedback anti-noise component. In instances when feedback filter 44 transitions from a state in which it is disabled from generating the feedback anti-noise component to a state in which it is enabled to generating the feedback anti-noise component (or vice versa), such gain may be smoothly ramped between two gain values to prevent an impulsive or fast change in the feedback anti-noise component which may negatively affect listener experience. Additionally or alternatively, in some embodiments, the gain of gain element 46 may be listener-configurable, for example via one or more user interface elements present on wireless telephone 10 and/or combox 16. In these and other embodiments, responsive to a determination that secondary path estimate adaptive filter 34A is not sufficiently modeling the electro-acoustic path in a frequency range (as described in greater detail below), secondary path estimate performance monitor 48 may disable feedback filter 44 from generating the feedback anti-noise component and/or reduce the effective gain of feedback filter 44 (e.g., relative to the effective gain employed when secondary path estimate adaptive filter 34A is sufficiently modeling the electro-acoustic path) by modifying the gain of gain element 46.

Although feedback filter 44 and gain element 46 are shown as separate components of ANC circuit 30, in some embodiments some structure and/or function of feedback filter 44 and gain element 46 may be combined. For example, in some of such embodiments, an effective gain of feedback filter 44 may be varied via control of one or more filter coefficients of feedback filter 44.

As shown in FIG. 3, ANC circuit 30 may also comprise secondary path estimate performance monitor 48. Secondary path estimate performance monitor 48 may comprise any system, device, or apparatus configured to compare error microphone signal err to the playback-corrected error microphone signal, thus giving an indication of how efficiently secondary path estimate adaptive filter 34A is modeling the electro-acoustic path of the source audio signal over various frequencies, as determined by the efficiency by which secondary path estimate adaptive filter 34A causes combiner 36 to remove the source audio signal from the error microphone signal in generating the playback-corrected error over various frequencies.

Responsive to a determination by a secondary path estimate performance monitor 48 that secondary path estimate adaptive filter 34A is not sufficiently modeling the electro-acoustic path of the source audio signal for a frequency range of sound, one or more components of CODEC IC 20 may perform an action. For example, responsive to a determination that secondary path estimate adaptive filter 34A is not sufficiently modeling the electro-acoustic path in a frequency range, compensating filter 28 may boost a source audio signal comprising signals ds and/or is within the frequency range. As another example, responsive to a determination that secondary path estimate adaptive filter 34A is not sufficiently modeling the electro-acoustic path in a frequency range, secondary path estimate performance monitor 48 may disable feedback filter 44 from generating the feedback anti-noise component and/or reduce the effective gain of feedback filter 44 (e.g., relative to the effective gain employed when secondary path estimate adaptive filter 34A is sufficiently modeling the electro-acoustic path) by modifying the gain of gain element 46. As another example, responsive to a determination that secondary path estimate adaptive filter 34A is not sufficiently modeling the electro-acoustic path in a frequency range, secondary path estimate performance monitor 48 may disable adaptive filter 32 from adapting, may mute adaptive filter 32 (e.g., disable it from generating the feedforward anti-noise component), and/or may reset adaptive filter 32.

To determine whether or not secondary path estimate adaptive filter 34A is not sufficiently modeling the electro-acoustic path of the source audio signal, secondary path estimate performance monitor 48 may calculate a secondary index performance index (SEPI) defined as:

$$\text{SEPI}=10 \log 10(P_E/P_{CE})$$

where $P_E$ is an estimated power of error microphone signal err and $P_{CE}$ is the power estimate of the playback corrected error PBCE. The above equation for SEPI may be rewritten as:

$$\text{SEPI}=10 \log 10[(P_{Ambient}+P_{(PB\cdot S(z))})/(P_{Ambient}+P_{(PB\cdot S(z)-SE(z))})]$$

where $P_{Ambient}$ is P an estimated power of the ambient noise and "PB" connotes the power is related to the source audio signal. When ambient noise is low, SEPI is directly related to the secondary path estimation SE(z). Thus, the higher SEPI, the better the secondary path estimate adaptive filter 34A (e.g., SE(z)) is modeling the electro-acoustic path of the source audio signal (e.g., S(z)). When ambient noise is not low:

$$\text{SEPI}=10 \log 10[(1+P_{(PB\cdot S(z))}/P_{Ambient})/(1+P_{(PB\cdot S(z)-SE(z)}/P_{Ambient})]$$

which may be rewritten as:

$$\text{SEPI}=10 \log 10[(1+\text{SNR})/(1+\text{SNR}\cdot\text{Model Error})]$$

where SNR is a signal-to-noise ratio wherein "signal" refers to the playback corrected error signal and "noise" refers to any other signal sensed by the error microphone E, and the Model Error is a value indicative of the error between SE(z) and S(z). When the Model Error is higher, SEPI is lower, and vice versa. Thus, by monitoring SEPI, secondary path estimate performance monitor 48 is effectively monitoring the signal-to-noise ratio of error microphone signal err together with the difference between SE(z) and S(z).

In order to provide a more accurate measure of the performance of secondary path estimate adaptive filter 34A, secondary path estimate performance monitor 48 may "smooth" its calculation of SEPI in order to filter out variations in the instantaneous calculation of SEPI. Thus, a smoothed SEPI, represented as $\text{SEPI}_{smooth}$, may equal a low-pass filtered, averaged, or rolling averaged version of instantaneous SEPI calculations. To increase system response speed, the instantaneous SEPI calculation may be used rather than $\text{SEPI}_{smooth}$ when the instantaneous SEPI calculation falls below a predetermined minimum threshold or rises above a predetermined maximum threshold.

When $\text{SEPI}_{smooth}$ is low, such an index value may mean that either the current signal-to-noise ratio is low for the secondary path estimation, or the secondary path estimation is not adequately modeling the electro-acoustic path of the source audio signal. In either event, it may not be desirable to adapt adaptive filter 32 and response W(z) during such time. Thus, when $\text{SEPI}_{smooth}$ is above a minimum performance threshold, secondary path estimate performance monitor 48 may take no actions on other components of CODEC IC 20. However, when $\text{SEPI}_{smooth}$ falls below such minimum performance threshold (e.g., indicating that response SE(z) is not well-adapted), secondary path estimate performance monitor 48 may disable adaptive filter 32 and response W(z) from adapting, as well as taking any or all of the other actions described herein as taking place responsive to a determination that secondary path estimate adaptive filter 34A is not sufficiently modeling the electro-acoustic path, until such time as $\text{SEPI}_{smooth}$ again rises above the minimum performance threshold. If $\text{SEPI}_{smooth}$ further falls below a reset threshold lower than the minimum performance threshold (e.g., indicating that SE(z) is much different than S(z), as may occur when a headphone 18A or 18B is removed from a listener's ear), the response W(z) may be reset and adaptive filter 32 may be disabled from generating the feedforward anti-noise component, as the then-current response W(z) may be based on a largely incorrect SE(z).

To effectively calculate SEPI, secondary path estimate performance monitor 48 requires a source audio signal (e.g., downlink speech signal ds and/or internal audio signal ia). Thus, without a source audio signal, secondary path estimate performance monitor 48 cannot effectively monitor the performance of secondary path estimate filter 34A. However, such inability to monitor may not be problematic in embodiments of ANC circuit 30 in which adaptive filter 32 adapts only when a source audio signal is present. Nonetheless, even in the absence of a source audio signal, it may be desirable to determine whether or not a headphone 18A, 18B has become disengaged from a listener's ear. Thus, to make such determination, secondary path estimate performance monitor 48 may examine a power ratio R(z) between reference signal ref and error microphone signal err at various frequencies. When adaptive filter 32 and secondary path estimate filter 34A effectively model the path between the reference microphone and the error microphone, the value of the power ratio R(z) should be small (e.g., near 1) in the absence of a source audio signal. However, if response SE(z) should change and cease effectively modeling response S(z), the value of power ratio R(z) may increase. By tracking the power ratio R(z) over various frequency bands, secondary path estimate performance monitor 48 may be able to make a determination of whether a headphone 18A, 18B is loose fitting, engaged with a listener's ear, disengaged with a listener's ear, a speaker thereof is covered by a portion of the listener's anatomy, and/or other conditions. As an example, secondary path estimate performance monitor 48 may determine that one or more of such conditions has occurred if the power ratio R(z) exceeds a threshold power ratio T(z) in a particular frequency band, where T(z) is determined by tracking the power ratio R(z) in well-trained settings (e.g., when a source audio signal is available). In response to the occurrence of any of such conditions or a determination that the power ratio R(z) exceeds a threshold power ratio T(z) in a particular frequency band, secondary path estimate performance monitor 48 may take any or all of the other actions described herein as taking place responsive to a determination that secondary path estimate adaptive filter 34A is not sufficiently modeling the electro-acoustic path.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A personal audio device comprising:

a personal audio device housing;

a transducer coupled to the housing for reproducing an audio signal including both a source audio signal for playback to a listener and an anti-noise signal for countering the effects of ambient audio sounds in an acoustic output of the transducer;

a reference microphone coupled to the housing for providing a reference microphone signal indicative of the ambient audio sounds;

an error microphone coupled to the housing in proximity to the transducer for providing an error microphone signal indicative of the acoustic output of the transducer and the ambient audio sounds at the transducer; and a processing circuit that implements:

a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component;

a secondary path estimate filter configured to model an electro-acoustic path of the source audio signal and have a response that generates a secondary path estimate from the source audio signal;

a secondary coefficient control block that shapes the response of the secondary path estimate adaptive filter in conformity with the source audio signal and the playback corrected error by adapting the response of the secondary path estimate adaptive filter to minimize the playback corrected error; and a feedforward filter having a response that generates a feedforward anti-noise signal component from the reference microphone signal; and wherein:

the anti-noise signal comprises at least the feedback anti-noise signal component and the feedforward anti-noise signal component; and the processing circuit modifies processing of the feedforward filter responsive to a disturbance in the reference microphone signal, wherein modifying processing of the feedforward filter comprises one of disabling the feedforward filter from generating the feedforward anti-noise signal component, disabling adaptation of the feedforward filter, and resetting adaptation of the feedforward filter.

2. The personal audio device of claim 1, wherein the processing circuit further implements a combiner to combine the source audio signal, the feedforward anti-noise signal component, and the feedback anti-noise signal component.

3. The personal audio device of claim 1, wherein the feedforward filter comprises an adaptive filter, and the processing circuit further implements a feedforward coefficient control block that shapes the response of the feedforward filter in conformity with the error microphone signal and the reference microphone signal by adapting the response of the feedforward filter to minimize the ambient audio sounds in the error microphone signal.

4. The personal audio device of claim 1, wherein the processing circuit further implements a programmable feedback gain, wherein an increasing programmable feedback gain increases the feedback anti-noise signal component and a decreasing programmable feedback gain decreases the feedback anti-noise signal component.

5. The personal audio device of claim 1, wherein the processing circuit further implements a secondary path estimate performance monitor for monitoring performance of the secondary path estimate adaptive filter in modeling the electro-acoustic path.

6. The personal audio device of claim 5, wherein the secondary path estimate performance monitor monitors performance of the secondary path estimate adaptive filter by comparing the error microphone signal to the playback corrected error.

7. The personal audio device of claim 5, wherein responsive to a determination by the secondary path estimate performance monitor that the secondary path estimate adaptive filter is not sufficiently modeling the electro-acoustic path, the processing circuit disables the feedback filter from generating the feedback anti-noise signal component.

8. The personal audio device of claim 7, wherein:

the processing circuit further implements a programmable feedback gain, wherein an increasing programmable feedback gain increases the feedback anti-noise signal component and a decreasing programmable feedback gain decreases the feedback anti-noise signal component; and the processing circuit disables the feedback filter by setting the programmable feedback gain to zero.

9. The personal audio device of claim 5, wherein:

the processing circuit further implements a programmable feedback gain, wherein an increasing programmable feedback gain increases the feedback anti-noise signal component and a decreasing programmable feedback gain decreases the feedback anti-noise signal component; and responsive to a determination by the secondary path estimate performance monitor that the secondary path estimate adaptive filter is not sufficiently modeling the electro-acoustic path, the processing circuit decreases the programmable feedback gain.

10. The personal audio device of claim 5, wherein responsive to a determination by the secondary path estimate performance monitor that the secondary path estimate adaptive filter is not sufficiently modeling the electro-acoustic path for a particular frequency range of sound, the processing circuit implements a compensating filter to boost the source audio signal within such frequency range to the source audio signal being communicated to at least one of the transducer, the secondary path estimate adaptive filter, and the secondary coefficient control block.

11. A method of for canceling ambient audio sounds in the proximity of a transducer of a personal audio device, the method comprising:

receiving a reference microphone signal indicative of the ambient audio sounds;

receiving an error microphone signal indicative of the output of the transducer and the ambient audio sounds at the transducer;

generating a source audio signal for playback to a listener;

generating a feedback anti-noise signal component from a playback corrected error, the playback corrected error based on a difference between the error microphone signal and a secondary path estimate, countering the effects of ambient audio sounds at an acoustic output of the transducer, wherein an anti-noise signal comprises at least the feedback anti-noise signal component;

adaptively generating the secondary path estimate from the source audio signal by filtering the source audio signal with a secondary path estimate adaptive filter modeling an electro-acoustic path of the source audio signal and adapting the response of the secondary path estimate adaptive filter to minimize the playback corrected error;

combining the anti-noise signal with the source audio signal to generate an audio signal provided to the transducer;

generating a feedforward anti-noise signal component, from a result of the measuring with the reference microphone, countering the effects of ambient audio sounds at an acoustic output of the transducer by filtering an output of the reference microphone, wherein the anti-noise signal comprises at least the feedback anti-noise signal component and the feedforward anti-noise signal component; and modifying processing of the feedforward anti-noise signal component responsive to a disturbance in the reference microphone signal, wherein modifying processing comprises one of disabling generation of the feedforward-anti-noise signal component, disabling adaptation of the feedforward-anti-noise signal component, and resetting the feedforward-anti-noise signal component.

12. The method of claim 11, further comprising generating the feedforward anti-noise signal by adapting a response of an adaptive filter that filters an output of the reference microphone to minimize the ambient audio sounds in the error microphone signal.

13. The method of claim 11, further comprising applying a programmable feedback gain to a path of the feedback anti-noise signal component, wherein an increasing programmable feedback gain increases the feedback anti-noise signal component and a decreasing programmable feedback gain decreases the feedback anti-noise signal component.

14. The method of claim 11, further comprising monitoring performance of the secondary path estimate adaptive filter in modeling the electro-acoustic path.

15. The method of claim 14, wherein monitoring performance of the secondary path estimate adaptive filter in modeling the electro-acoustic path comprises comparing the error microphone signal to the playback corrected error.

16. The method of claim 14, further comprising disabling generation of the feedback anti-noise signal component responsive to a determination by the secondary path estimate performance monitor that the secondary path estimate adaptive filter is not sufficiently modeling the electro-acoustic path.

17. The method of claim 16, further comprising applying a programmable feedback gain to a path of the feedback anti-noise signal component, wherein an increasing programmable feedback gain increases the feedback anti-noise signal component and a decreasing programmable feedback gain decreases the feedback anti-noise signal component, and wherein disabling generation of the feedback anti-noise signal component comprises setting the programmable feedback gain to zero.

18. The method of claim 16, further comprising:

applying a programmable feedback gain to a path of the feedback anti-noise signal component, wherein an increasing programmable feedback gain increases the feedback anti-noise signal component and a decreasing programmable feedback gain decreases the feedback anti-noise signal component; and decreasing the programmable feedback gain responsive to a determination that the secondary path estimate filter is not sufficiently modeling the electro-acoustic path.

19. The method of claim 14, further comprising boosting, within a frequency range, the source audio signal communicated to the at least one of the transducer, the secondary path estimate adaptive filter, and the secondary coefficient control block responsive to a determination by the secondary path estimate performance monitor that the secondary path estimate adaptive filter is not sufficiently modeling the electro-acoustic path.

20. An integrated circuit for implementing at least a portion of a personal audio device, comprising:

an output for providing a signal to a transducer including both a source audio signal for playback to a listener and an anti-noise signal for countering the effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements:

a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component;

a secondary path estimate adaptive filter for modeling an electro-acoustic path of the source audio signal having a response that generates the secondary path estimate from the source audio signal;

a secondary coefficient control block that shapes the response of the secondary path estimate adaptive filter in conformity with the source audio signal and the playback corrected error by adapting the response of the secondary path estimate adaptive filter to minimize the playback corrected error; and a feedforward filter having a response that generates a feedforward anti-noise signal component from the reference microphone signal; and wherein:

the anti-noise signal comprises at least the feedback anti-noise signal component and the feedforward anti-noise signal component; and the processing circuit modifies processing of the feedforward filter responsive to a disturbance in the reference microphone signal, wherein modifying processing of the feedforward filter comprises one of disabling the feedforward filter from generating the feedforward anti-noise signal component, disabling adaptation of the feedforward filter, and resetting adaptation of the feedforward filter.

21. The integrated circuit of claim 20, wherein the processing circuit further implements a combiner to combine the source audio signal, the feedforward anti-noise signal component, and the feedback anti-noise signal component.

22. The integrated circuit of claim 20, wherein the feedforward filter comprises an adaptive filter, and the processing circuit further implements a feedforward coefficient control block that shapes the response of the feedforward filter in conformity with the error microphone signal and the reference microphone signal by adapting the response of the feedforward filter to minimize the ambient audio sounds in the error microphone signal.

23. The integrated circuit of claim 20, wherein the processing circuit further implements a programmable feedback gain, wherein an increasing programmable feedback gain increases the feedback anti-noise signal component and a decreasing programmable feedback gain decreases the feedback anti-noise signal component.

24. The integrated circuit of claim 20, wherein the processing circuit further implements a secondary path estimate performance monitor for monitoring performance of the secondary path estimate adaptive filter in modeling the electro-acoustic path.

25. The integrated circuit of claim 24, wherein the secondary path estimate performance monitor monitors performance of the secondary path estimate adaptive filter by comparing the error microphone signal to the playback corrected error.

26. The integrated circuit of claim 24, wherein responsive to a determination by the secondary path estimate performance monitor that the secondary path estimate adaptive filter is not sufficiently modeling the electro-acoustic path, the processing circuit disables the feedback filter from generating the feedback anti-noise signal component.

27. The integrated circuit of claim 26, wherein:

the processing circuit further implements a programmable feedback gain, wherein an increasing programmable feedback gain increases the feedback anti-noise signal component and a decreasing programmable feedback gain decreases the feedback anti-noise signal component; and the processing circuit disables the feedback filter by setting the programmable feedback gain to zero.

28. The integrated circuit of claim 24, wherein:

the processing circuit further implements a programmable feedback gain, wherein an increasing programmable feedback gain increases the feedback anti-noise signal component and a decreasing programmable feedback gain decreases the feedback anti-noise signal component; and responsive to a determination by the secondary path estimate performance monitor that the secondary path estimate adaptive filter is not sufficiently modeling the electro-acoustic path, the processing circuit decreases the programmable feedback gain.

29. The integrated circuit of claim 24, wherein responsive to a determination by the secondary path estimate performance monitor that the secondary path estimate adaptive filter is not sufficiently modeling the electro-acoustic path for a particular frequency range of sound, the processing circuit implements a compensating filter to boost the source audio signal within such frequency range to the source audio signal being communicated to at least one of the transducer, the secondary path estimate adaptive filter, and the secondary coefficient control block.

30. A personal audio device comprising:

a personal audio device housing;

a transducer coupled to the housing for reproducing an audio signal including both a source audio signal for playback to a listener and an anti-noise signal for countering the effects of ambient audio sounds in an acoustic output of the transducer;

an error microphone coupled to the housing in proximity to the transducer for providing an error microphone signal indicative of the acoustic output of the transducer and the ambient audio sounds at the transducer;

a processing circuit that implements:

a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component;

a secondary path estimate filter configured to model an electro-acoustic path of the source audio signal and have a response that generates a secondary path estimate from the source audio signal;

a programmable feedback gain, wherein an increasing programmable feedback gain increases the feedback anti-noise signal component and a decreasing programmable feedback gain decreases the feedback anti-noise signal component; and a reference microphone coupled to the housing for providing a reference microphone signal indicative of the ambient audio sounds;

wherein:

the processing circuit further implements a feedforward filter having a response that generates a feedforward anti-noise signal component from the reference microphone signal the anti-noise signal comprises at least the feedback anti-noise signal component and the feedforward anti-noise signal component; and the processing circuit modifies processing of the feedforward filter responsive to a disturbance in the reference microphone signal, wherein modifying processing of the feedforward filter comprises one of disabling the feedforward filter from generating the feedforward anti-noise signal component, disabling adaptation of the feedforward filter, and resetting adaptation of the feedforward filter.

31. The personal audio device of claim 30, wherein the processing circuit further implements a combiner to combine the source audio signal, the feedforward anti-noise signal component, and the feedback anti-noise signal component.

32. The personal audio device of claim 30, wherein the feedforward filter comprises an adaptive filter, and the processing circuit further implements a feedforward coefficient control block that shapes the response of the feedforward filter in conformity with the error microphone signal and the reference microphone signal by adapting the response of the feedforward filter to minimize the ambient audio sounds in the error microphone signal.

33. The personal audio device of claim 30, wherein the processing circuit further implements a secondary path estimate performance monitor for monitoring performance of the secondary path estimate filter in modeling the electro-acoustic path.

34. The personal audio device of claim 33, wherein the secondary path estimate performance monitor monitors performance of the secondary path estimate filter by comparing the error microphone signal to the playback corrected error.

35. The personal audio device of claim 33, wherein responsive to a determination by the secondary path estimate performance monitor that the secondary path estimate filter is not sufficiently modeling the electro-acoustic path, the processing circuit disables the feedback filter from generating the feedback anti-noise signal component.

36. The personal audio device of claim 35, wherein the processing circuit disables the feedback filter by setting the programmable feedback gain to zero.

37. The personal audio device of claim 33, wherein responsive to a determination by the secondary path estimate performance monitor that the secondary path estimate filter is not sufficiently modeling the electro-acoustic path, the processing circuit decreases the programmable feedback gain.

38. The personal audio device of claim 33, wherein responsive to a determination by the secondary path estimate performance monitor that the secondary path estimate filter is not sufficiently modeling the electro-acoustic path for a particular frequency range of sound, the processing circuit implements a compensating filter to boost the source audio signal within such frequency range to the source audio signal being communicated to the transducer and the secondary path estimate filter.

39. A method of for canceling ambient audio sounds in the proximity of a transducer of a personal audio device, the method comprising:

receiving an error microphone signal indicative of the output of the transducer and the ambient audio sounds at the transducer;

generating a source audio signal for playback to a listener;

generating a feedback anti-noise signal component from a playback corrected error, the playback corrected error based on a difference between the error microphone signal and a secondary path estimate, countering the effects of ambient audio sounds at an acoustic output of the transducer, wherein an anti-noise signal comprises at least the feedback anti-noise signal component;

generating the secondary path estimate from the source audio signal by filtering the source audio signal with a secondary path estimate filter modeling an electro-acoustic path of the source audio signal;

applying a programmable feedback gain to a path of the feedback anti-noise signal component, wherein an increasing programmable feedback gain increases the feedback anti-noise signal component and a decreasing programmable feedback gain decreases the feedback anti-noise signal component; and combining the anti-noise signal with a source audio signal to generate an audio signal provided to the transducer;

receiving a reference microphone signal indicative of the ambient audio sounds;

generating a feedforward anti-noise signal component, from a result of the measuring with the reference microphone, countering the effects of ambient audio sounds at an acoustic output of the transducer by filtering an output of the reference microphone, wherein the anti-noise signal comprises at least the feedback anti-noise signal component and the feedforward anti-noise signal component; and modifying processing of the feedforward anti-noise signal component responsive to a disturbance in the reference microphone signal, wherein modifying processing comprises one of disabling generation of the feedforward-anti-noise signal component, disabling adaptation of the feedforward-anti-noise signal component, and resetting the feedforward-anti-noise signal component.

40. The method of claim 39, further comprising generating the feedforward anti-noise signal by adapting a response of an adaptive filter that filters an output of the reference microphone to minimize the ambient audio sounds in the error microphone signal.

41. The method of claim 39, further comprising monitoring performance of the secondary path estimate filter in modeling the electro-acoustic path.

42. The method of claim 41, wherein monitoring performance of the secondary path estimate filter in modeling the electro-acoustic path comprises comparing the error microphone signal to the playback corrected error.

43. The method of claim 41, further comprising disabling generation of the feedback anti-noise signal component responsive to a determination by the secondary path estimate performance monitor that the secondary path estimate filter is not sufficiently modeling the electro-acoustic path.

44. The method of claim 43, wherein disabling generation of the feedback anti-noise signal component comprises setting the programmable feedback gain to zero.

45. The method of claim 41, further comprising decreasing the programmable feedback gain responsive to a determination that the secondary path estimate filter is not sufficiently modeling the electro-acoustic path.

46. The method of claim 41, further comprising boosting, within a frequency range, the source audio signal communicated to the at least one of the transducer, the secondary path estimate filter, and the secondary coefficient control block responsive to a determination by the secondary path estimate performance monitor that the secondary path estimate filter is not sufficiently modeling the electro-acoustic path.

47. An integrated circuit for implementing at least a portion of a personal audio device, comprising:

an output for providing a signal to a transducer including both a source audio signal for playback to a listener and an anti-noise signal for countering the effect of ambient audio sounds in an acoustic output of the transducer;

an error microphone input for receiving an error microphone signal indicative of the output of the transducer and the ambient audio sounds at the transducer; and a processing circuit that implements:

a feedback filter having a response that generates a feedback anti-noise signal component from a playback corrected error, the playback corrected error based on a difference between the error microphone signal and a secondary path estimate, and wherein the anti-noise signal comprises at least the feedback anti-noise signal component;

a secondary path estimate filter configured to model an electro-acoustic path of the source audio signal and have a response that generates a secondary path estimate from the source audio signal; and a programmable feedback gain, wherein an increasing programmable feedback gain increases the feedback anti-noise signal component and a decreasing programmable feedback gain decreases the feedback anti-noise signal component; and a reference microphone input for receiving a reference microphone signal indicative of the ambient audio sounds;

wherein:

the processing circuit further implements a feedforward filter having a response that generates a feedforward anti-noise signal component from the reference microphone signal the anti-noise signal comprises at least the feedback anti-noise signal component and the feedforward anti-noise signal component; and the processing circuit modifies processing of the feedforward filter responsive to a disturbance in the reference microphone signal, wherein modifying processing of the feedforward filter comprises one of disabling the feedforward filter from generating the feedforward anti-noise signal component, disabling adaptation of the feedforward filter, and resetting adaptation of the feedforward filter.

48. The integrated circuit of claim 47, wherein the processing circuit further implements a combiner to combine the source audio signal, the feedforward anti-noise signal component, and the feedback anti-noise signal component.

49. The integrated circuit of claim 47, wherein the feedforward filter comprises an adaptive filter, and the processing circuit further implements a feedforward coefficient control block that shapes the response of the feedforward filter in conformity with the error microphone signal and the reference microphone signal by adapting the response of the feedforward filter to minimize the ambient audio sounds in the error microphone signal.

50. The integrated circuit of claim 47, wherein the processing circuit further implements a secondary path estimate performance monitor for monitoring performance of the secondary path estimate filter in modeling the electro-acoustic path.

51. The integrated circuit of claim 50, wherein the secondary path estimate performance monitor monitors performance of the secondary path estimate filter by comparing the error microphone signal to the playback corrected error.

52. The integrated circuit of claim 50, wherein responsive to a determination by the secondary path estimate performance monitor that the secondary path estimate filter is not sufficiently modeling the electro-acoustic path, the processing circuit disables the feedback filter from generating the feedback anti-noise signal component.

53. The integrated circuit of claim 52, wherein the processing circuit disables the feedback filter by setting the programmable feedback gain to zero.

54. The integrated circuit of claim 50, wherein responsive to a determination by the secondary path estimate performance monitor that the secondary path estimate filter is not sufficiently modeling the electro-acoustic path, the processing circuit decreases the programmable feedback gain.

55. The integrated circuit of claim 50, wherein responsive to a determination by the secondary path estimate performance monitor that the secondary path estimate filter is not sufficiently modeling the electro-acoustic path for a particular frequency range of sound, the processing circuit implements a compensating filter to boost the source audio signal within such frequency range to the source audio signal being communicated to the transducer and the secondary path estimate filter.

56. A personal audio device comprising:

a personal audio device housing;

a transducer coupled to the housing for reproducing an audio signal including both a source audio signal for playback to a listener and an anti-noise signal for countering the effects of ambient audio sounds in an acoustic output of the transducer;

a reference microphone coupled to the housing for providing a reference microphone signal indicative of the ambient audio sounds;

an error microphone coupled to the housing in proximity to the transducer for providing an error microphone signal indicative of the acoustic output of the transducer and the ambient audio sounds at the transducer; and a processing circuit that implements:

a feedback filter having a response that generates a feedback anti-noise signal component from a playback corrected error, the playback corrected error based on a difference between the error microphone signal and a secondary path estimate;

a feedforward filter having a response that generates a feedforward anti-noise signal component from the reference microphone signal, wherein the anti-noise signal comprises at least the feedback anti-noise signal component and the feedforward anti-noise signal component, wherein the feedforward filter is configured to be disabled from generating the feedforward anti-noise signal component responsive to a disturbance in the reference microphone signal; and a secondary path estimate filter configured to model an electro-acoustic path of the source audio signal and have a response that generates a secondary path estimate from the source audio signal.

57. The personal audio device of claim 56, wherein the secondary path estimate filter is an adaptive filter, and the processing circuit further implements a secondary coefficient control block that shapes the response of the secondary path estimate filter in conformity with the source audio signal and the playback corrected error by adapting the response of the secondary path estimate adaptive filter to minimize the playback corrected error.

58. The personal audio device of claim 56, wherein the processing circuit further implements a combiner to combine the source audio signal, the feedforward anti-noise signal component, and the feedback anti-noise signal component.

59. The personal audio device of claim 56, wherein the feedforward filter comprises an adaptive filter, and the processing circuit further implements a feedforward coefficient control block that shapes the response of the feedforward filter in conformity with the error microphone signal and the reference microphone signal by adapting the response of the feedforward filter to minimize the ambient audio sounds in the error microphone signal.

60. The personal audio device of claim 56, wherein the processing circuit further implements a programmable feedback gain, wherein an increasing programmable feedback gain increases the feedback anti-noise signal component and a decreasing programmable feedback gain decreases the feedback anti-noise signal component.

61. The personal audio device of claim 56, wherein the processing circuit further implements a secondary path estimate performance monitor for monitoring performance of the secondary path estimate filter in modeling the electro-acoustic path.

62. The personal audio device of claim 61, wherein the secondary path estimate performance monitor monitors performance of the secondary path estimate filter by comparing the error microphone signal to the playback corrected error.

63. The personal audio device of claim 61, wherein responsive to a determination by the secondary path estimate performance monitor that the secondary path estimate filter is not sufficiently modeling the electro-acoustic path, the processing circuit disables the feedback filter from generating the feedback anti-noise signal component.

64. The personal audio device of claim 63, wherein:

the processing circuit further implements a programmable feedback gain, wherein an increasing programmable feedback gain increases the feedback anti-noise signal component and a decreasing programmable feedback gain decreases the feedback anti-noise signal component; and the processing circuit disables the feedback filter by setting the programmable feedback gain to zero.

65. The personal audio device of claim 61, wherein:

the processing circuit further implements a programmable feedback gain, wherein an increasing programmable feedback gain increases the feedback anti-noise signal component and a decreasing programmable feedback gain decreases the feedback anti-noise signal component; and responsive to a determination by the secondary path estimate performance monitor that the secondary path estimate filter is not sufficiently modeling the electro-acoustic path, the processing circuit decreases the programmable feedback gain.

66. The personal audio device of claim 61, wherein responsive to a determination by the secondary path estimate performance monitor that the secondary path estimate filter is not sufficiently modeling the electro-acoustic path for a particular frequency range of sound, the processing circuit implements a compensating filter to boost the source audio signal within such frequency range to the source audio signal being communicated to the transducer and the secondary path estimate filter.

67. A method for canceling ambient audio sounds in the proximity of a transducer of a personal audio device, the method comprising:

receiving a reference microphone signal indicative of the ambient audio sounds;

receiving an error microphone signal indicative of the output of the transducer and the ambient audio sounds at the transducer;

generating a source audio signal for playback to a listener;

generating a feedback anti-noise signal component from a playback corrected error, the playback corrected error based on a difference between the error microphone signal and a secondary path estimate, countering the effects of ambient audio sounds at an acoustic output of the transducer, wherein an anti-noise signal comprises at least the feedback anti-noise signal component;

generating the secondary path estimate from the source audio signal by filtering the source audio signal with a secondary path estimate filter modeling an electro-acoustic path of the source audio signal;

generating a feedforward anti-noise signal component, from a result of the measuring with the reference microphone, countering the effects of ambient audio sounds at an acoustic output of the transducer by filtering with a feedforward filter an output of the reference microphone, wherein the anti-noise signal comprises at least the feedback anti-noise signal component and the feedforward anti-noise signal component;

disabling the feedforward filter from generating the feedforward anti-noise signal component responsive to a disturbance in the reference microphone signal; and combining the anti-noise signal with a source audio signal to generate an audio signal provided to the transducer.

68. The method of claim 67, further comprising adapting the response of the secondary path estimate filter to minimize the playback corrected error.

69. The method of claim 67, further comprising generating the feedforward anti-noise signal by adapting a response of an adaptive filter that filters an output of the reference microphone to minimize the ambient audio sounds in the error microphone signal.

70. The method of claim 67, further comprising applying a programmable feedback gain to a path of the feedback anti-noise signal component, wherein an increasing programmable feedback gain increases the feedback anti-noise signal component and a decreasing programmable feedback gain decreases the feedback anti-noise signal component.

71. The method of claim 67, further comprising monitoring performance of the secondary path estimate filter in modeling the electro-acoustic path.

72. The method of claim 71, wherein monitoring performance of the secondary path estimate filter in modeling the electro-acoustic path comprises comparing the error microphone signal to the playback corrected error.

73. The method of claim 71, further comprising disabling generation of the feedback anti-noise signal from generating the feedback anti-noise signal component responsive to a determination by the secondary path estimate performance monitor that the secondary path estimate filter is not sufficiently modeling the electro-acoustic path.

74. The method of claim 71, further comprising applying a programmable feedback gain to a path of the feedback anti-noise signal component, wherein an increasing programmable feedback gain increases the feedback anti-noise signal component and a decreasing programmable feedback gain decreases the feedback anti-noise signal component, and wherein disabling generation of the feedback anti-noise signal component comprises setting the programmable feedback gain to zero.

75. The method of claim 71, further comprising:

applying a programmable feedback gain to a path of the feedback anti-noise signal component, wherein an increasing programmable feedback gain increases the feedback anti-noise signal component and a decreasing programmable feedback gain decreases the feedback anti-noise signal component; and decreasing the programmable feedback gain responsive to a determination that the secondary path estimate filter is not sufficiently modeling the electro-acoustic path.

76. The method of claim 67, further comprising boosting, within a frequency range, the source audio signal communicated to the at least one of the transducer, the secondary path estimate filter, and the secondary coefficient control block responsive to a determination by a secondary path estimate performance monitor that the secondary path estimate filter is not sufficiently modeling the electro-acoustic path.

77. An integrated circuit for implementing at least a portion of a personal audio device, comprising:

an output for providing a signal to a transducer including both a source audio signal for playback to a listener and an anti-noise signal for countering the effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements:

a feedback filter having a response that generates a feedback anti-noise signal component from a playback corrected error, the playback corrected error based on a difference between the error microphone signal and a secondary path estimate;

a feedforward filter having a response that generates a feedforward anti-noise signal component from the reference microphone signal, wherein the anti-noise signal comprises at least the feedback anti-noise signal component and the feedforward anti-noise signal component, wherein the feedforward filter is configured to be disabled from generating the feedforward anti-noise signal component responsive to a disturbance in the reference microphone signal; and a secondary path estimate filter configured to model an electro-acoustic path of the source audio signal and have a response that generates a secondary path estimate from the source audio signal.

78. The integrated circuit of claim 77, wherein the secondary path estimate filter is an adaptive filter, and the processing circuit further implements a secondary coefficient control block that shapes the response of the secondary path estimate filter in conformity with the source audio signal and the playback corrected error by adapting the response of the secondary path estimate adaptive filter to minimize the playback corrected error.

79. The integrated circuit of claim 77, wherein the processing circuit further implements a combiner to combine the source audio signal, the feedforward anti-noise signal component, and the feedback anti-noise signal component.

80. The integrated circuit of claim 77, wherein the feedforward filter comprises an adaptive filter, and the processing circuit further implements a feedforward coefficient control block that shapes the response of the feedforward filter in conformity with the error microphone signal and the reference microphone signal by adapting the response of the feedforward filter to minimize the ambient audio sounds in the error microphone signal.

81. The integrated circuit of claim 77, wherein the processing circuit further implements a programmable feedback gain, wherein an increasing programmable feedback gain increases the feedback anti-noise signal component and a decreasing programmable feedback gain decreases the feedback anti-noise signal component.

82. The integrated circuit of claim 77, wherein the processing circuit further implements a secondary path estimate performance monitor for monitoring performance of the secondary path estimate filter in modeling the electro-acoustic path.

83. The integrated circuit of claim 82, wherein the secondary path estimate performance monitor monitors performance of the secondary path estimate filter by comparing the error microphone signal to the playback corrected error.

84. The integrated circuit of claim 82, wherein responsive to a determination by the secondary path estimate performance monitor that the secondary path estimate filter is not sufficiently modeling the electro-acoustic path, the processing circuit disables the feedback filter from generating the feedback anti-noise signal component.

85. The integrated circuit of claim 84, wherein:

the processing circuit further implements a programmable feedback gain, wherein an increasing programmable feedback gain increases the feedback anti-noise signal component and a decreasing programmable feedback gain decreases the feedback anti-noise signal component; and the processing circuit disables the feedback filter by setting the programmable feedback gain to zero.

86. The integrated circuit of claim 82, wherein:

the processing circuit further implements a programmable feedback gain, wherein an increasing programmable feedback gain increases the feedback anti-noise signal component and a decreasing programmable feedback gain decreases the feedback anti-noise signal component; and responsive to a determination by the secondary path estimate performance monitor that the secondary path estimate filter is not sufficiently modeling the electro-acoustic path, the processing circuit decreases the programmable feedback gain.

87. The integrated circuit of claim 82, wherein responsive to a determination by the secondary path estimate performance monitor that the secondary path estimate filter is not sufficiently modeling the electro-acoustic path for a particular frequency range of sound, the processing circuit implements a compensating filter to boost the source audio signal within such frequency range to the source audio signal being communicated to the transducer and the secondary path estimate filter.

* * * * *